US005156250A

United States Patent [19]

Parish et al.

[11] Patent Number: 5,156,250

[45] Date of Patent: Oct. 20, 1992

[54] LIQUID DIVERTER FOR CURRENCY RECEIVER

[75] Inventors: Stanley G. Parish, Dallas; Clarence D. Zierhut, Richardson, both of Tex.

[73] Assignee: Mid-South Enterprises, Dallas, Tex.

[21] Appl. No.: 766,032

[22] Filed: Sep. 26, 1991

[51] Int. Cl.[5] ..... G07F 1/02

[52] U.S. Cl. ..... 194/348; 194/351

[58] Field of Search ..... 194/347, 348, 349, 351, 194/344, 206, 207

[56] References Cited

U.S. PATENT DOCUMENTS

| | | | |
|---|---|---|---|
| 4,165,802 | 8/1979 | Mathews | 194/344 |
| 4,306,644 | 12/1981 | Rockola et al. | 194/348 |
| 4,513,439 | 4/1985 | Gorgone et al. | 194/206 X |

FOREIGN PATENT DOCUMENTS

| | | | |
|---|---|---|---|
| 1-306982 | 12/1989 | Japan | 194/348 |
| 2-118795 | 5/1990 | Japan | 194/348 |

*Primary Examiner*—F. J. Bartuska

*Attorney, Agent, or Firm*—Ross, Howison, Clapp & Korn

[57] ABSTRACT

A liquid diverting device for a currency receiver having an entrance slot for receipt of currency includes structure for diverting liquid from the entrance slot of the currency receiver. The structure includes a top wall, a bottom wall, first and second side walls, and first and second end walls. The device is disposed adjacent to the entrance slot of the currency receiver. The first side wall includes an inlet slot for receipt of currency. The second side wall includes an outlet slot for passing currency to the entrance slot of the currency receiver. The outlet slot is aligned with the entrance slot of the currency receiver. The diverting structure includes a channel interconnecting the inlet slot and the outlet slot. The channel extends between the top and bottom walls and the side walls for providing a passageway for currency through the diverting structure. The bottom wall includes a plurality of apertures for the removal from the channel of liquid. Structure extends from the top wall into the channel for diverting liquid entering the inlet slot toward the plurality of apertures in the bottom wall, thereby diverting liquid from the outlet slot and away from the entrance to the currency receiver.

15 Claims, 5 Drawing Sheets

LIQUID DIVERTER FOR CURRENCY RECEIVER

TECHNICAL FIELD OF THE INVENTION

This invention relates to currency receiving devices, and more particularly to a liquid diverter for diverting liquid from an input slot of a currency receiving device.

BACKGROUND OF THE INVENTION

In the operation of automatic, currency-controlled vending machines, currency is normally inserted into a receiving slot of the machine, and transported to a currency validator. The currency is either rejected or accepted, and upon acceptance, a selected item is dispensed to the user of the vending machine. The validator device actuates electronic circuitry which controls the dispensing of various items as well as causes the delivery of coins representing the overage amount of the currency received by the machine.

Unscrupulous customers have developed ways to cheat or beat such vending machines by pouring or squirting liquid, such as salt water, into the currency receiver slot. When liquid is squirted into the currency receiver slot of the vending machine or currency validator, the liquid runs into the validator and credit mechanisms, thereby shorting these related circuits and generally damaging the apparatus. On occasion, this shorting may cause a vending machine to "jackpot" or vend one or more times or even until all merchandise is dispensed from the vending machine. In other instances, the shorted circuits may cause money to be dispensed through the change or coin return mechanism thereby delivering all coins stored within the vending machine.

A need has thus arisen for a liquid diverter for a currency receiver or bill validator for a vending machine for diverting liquid which may enter the currency receiving slot cf the vending machine thereby preventing undesirable electrical conditions from occurring and preventing malfunction of the vending machine.

SUMMARY OF THE INVENTION

In accordance with the present invention, a liquid diverting device for a currency receiver having an entrance slot for receipt of currency is provided. The device includes structure for diverting liquid from the entrance slot of the currency receiver. The structure includes a top wall, a bottom wall, first and second side walls, and first. and second end walls. The device is disposed adjacent to the entrance slot of the currency receiver. The first side wall includes an inlet slot for receipt of currency. The second side wall includes an outlet slot for passing currency to the entrance slot of the currency receiver. The outlet slot is aligned with the entrance slot of the currency receiver. The diverting structure includes a channel interconnecting the inlet slot and the outlet slot. The channel extends between the top and bottom walls and the side walls for providing a passageway for currency through the diverting structure. The bottom wall includes a plurality of apertures for the removal from the channel of liquid. Structure extends from the top wall into the channel for diverting liquid entering the inlet slot toward the plurality of apertures in the bottom wall, thereby diverting liquid from the outlet slot and away from the entrance to the currency receiver.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
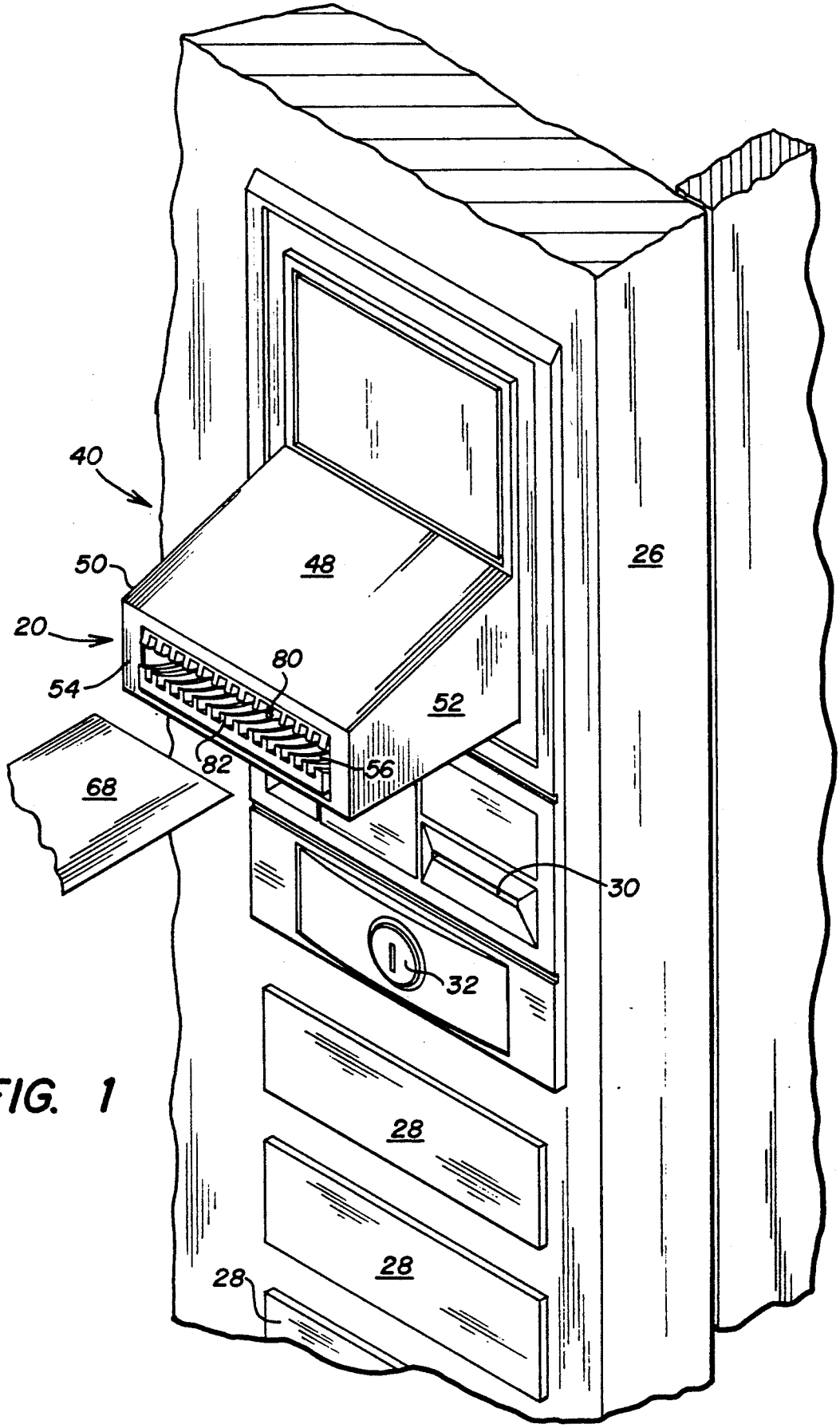
FIG. 1 is a perspective view of a beverage vending machine including the present liquid diverter.
Figure 2:
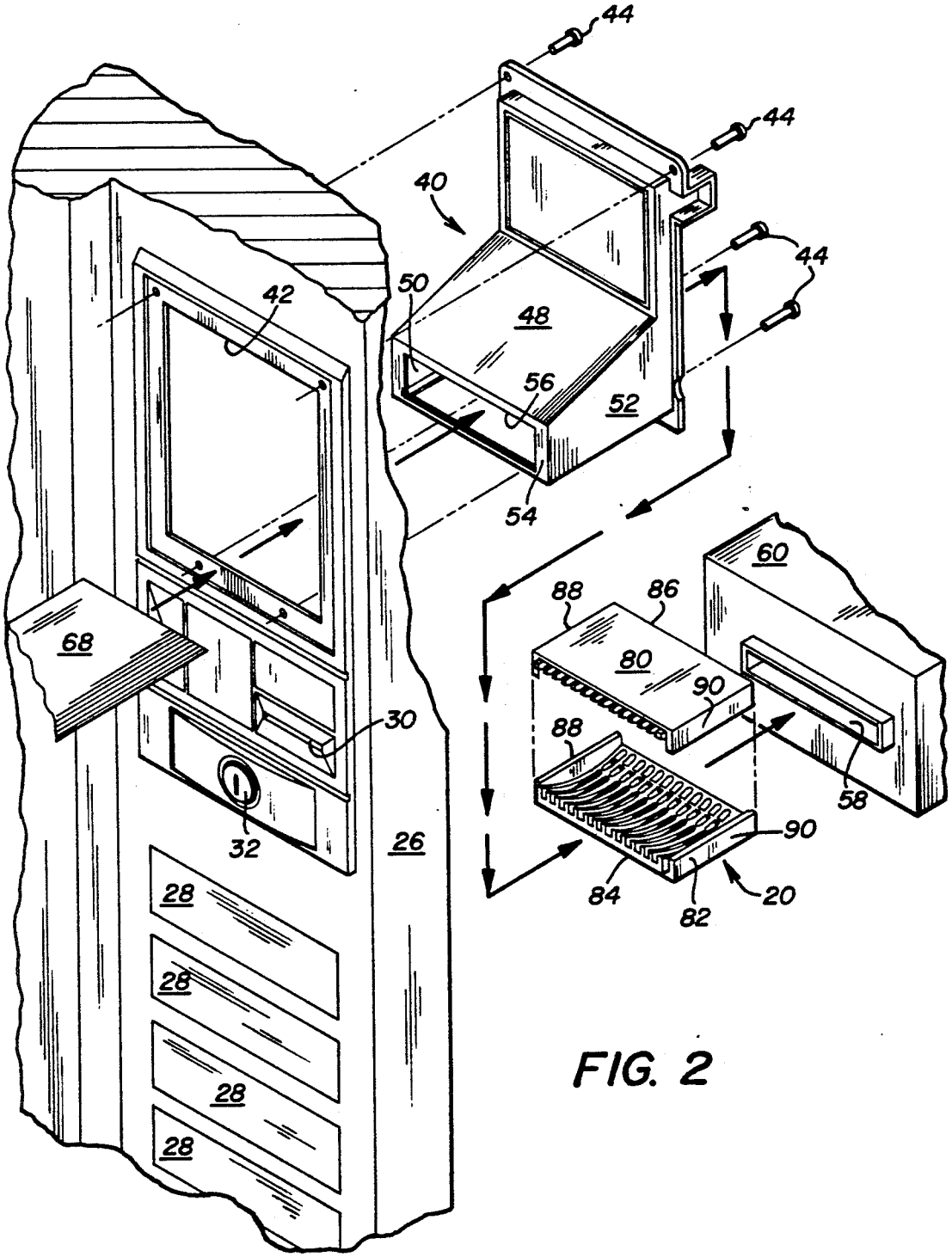
FIG. 2 is an exploded perspective view of the beverage vending machine including the liquid diverter of the present invention shown in FIG. 1.
Figure 3:
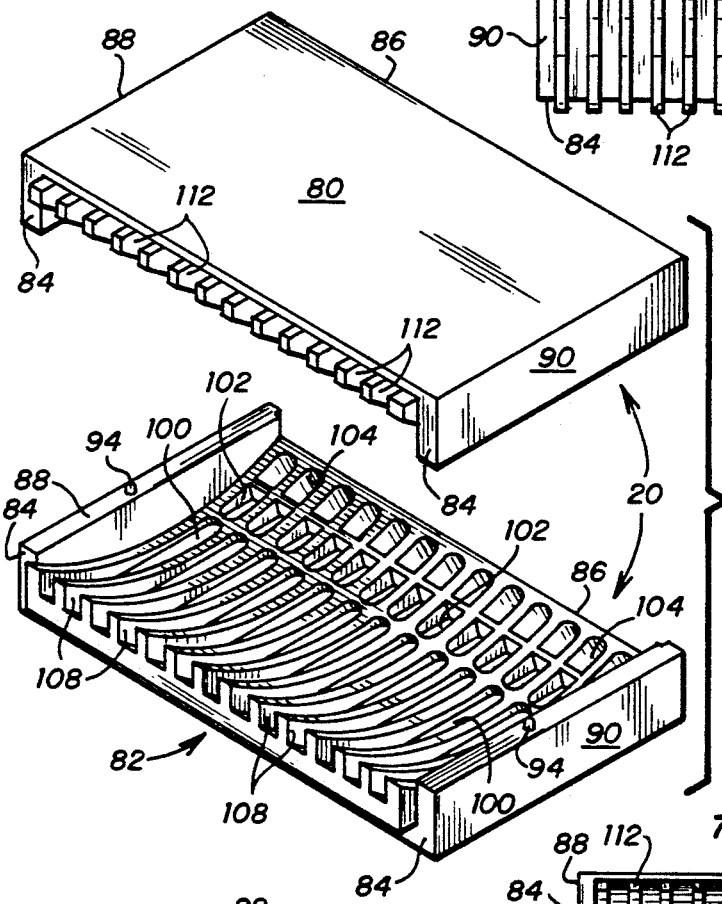
FIG. 3 is an exploded perspective view of a first embodiment of the present liquid diverter.

Referring simultaneously to FIGS. 1, 2, and 3, the present liquid diverter is illustrated, and is generally identified by the numeral 20. Liquid diverter 20 may be used with, for example, a beverage vending machine generally identified by the numeral 22, it being understood that the present liquid diverter can be used with any type of vending machine which accepts currency such as, for example, food or beverage vending machines, postage stamp vending machines, as well as automatic teller machines (ATM) and the like. Vending machine 22 includes a door 26 on which are mounted selection buttons 28 used for user selection of the desired articles to be dispensed. Door 26 includes a coin receiving slot 30 and a lock 32.

Liquid diverter 20 is mounted within a housing, generally identified by the numeral 40. Housing 40 is mounted to door 26 through an aperture 42 contained within door 26. Fastening devices 44 are utilized for mounting housing 40 to door 26. Housing 40 includes a top wall 48, side walls 50 and 52 and a front wall 54. Front wall 54 includes an aperture 56 through which liquid diverter 20 extends. Liquid diverter 20 is mounted within housing 40 to be positioned adjacent to a slot 58 of a bill validator 60.

As best illustrated in FIG. 2, currency 68 in the form of a dollar bill or other denominated bills, enters liquid diverter 20 through aperture 56 of housing 40, passes through liquid diverter 20 to slot 58 of bill validator 60. The function of liquid diverter 20 is to prevent the introduction of liquid into slot 58 of bill validator 60 to prevent electronic malfunction of bill validator 60 and vending machine 22.

Referring simultaneously to FIGS. 2–7, liquid diverter 20 is illustrated as having a top member generally identified by the numeral 80, and a bottom member generally identified by the numeral 82, it being understood that top member 80 and bottom member 82 may be fabricated from a single component. Liquid diverter 20 includes a first side wall 84, a second side wall 86, a first end wall 88 and a second end wall 90. Bottom member 82 includes pins 94 (FIG. 3) which mate with apertures 96 (FIG. 5) for aligning top member 80 with bottom member 82.

Bottom member 82 includes a plurality of elongated slotted apertures 100 extending between end walls 88 and 90. Further disposed within bottom member 82 are a plurality of apertures 102 and 104 which are aligned with apertures 100 and which extend between end walls 88 and 90 of bottom member 82.

Figure 4:
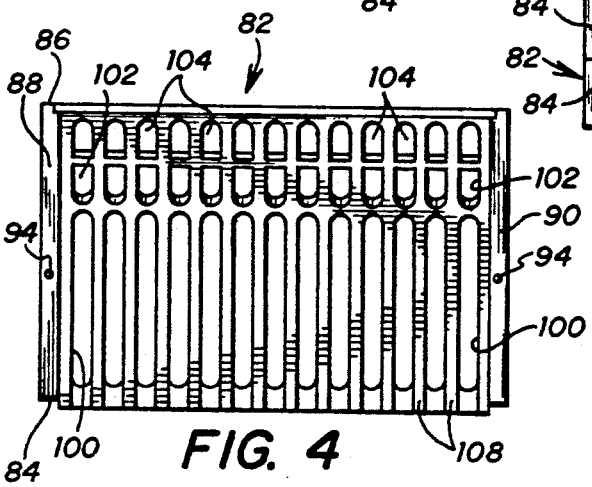
FIG. 4 is a top plan view of the bottom portion of the liquid diverter shown in FIG. 3.

As more clearly illustrated in FIGS. 3 and 4, interdisposed between apertures 100, 102, and 104, are a plurality of upstanding curvilinear faced ribs 108. Ribs 108 extend between side walls 84 and 86 and form the surface over which currency 68 travels through liquid diverter 20.

Figure 5:
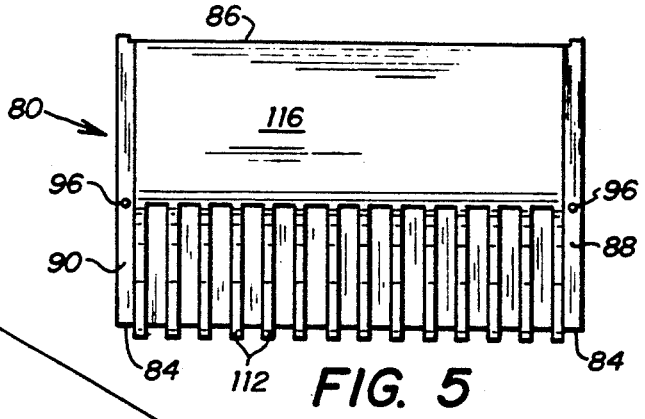
FIG. 5 is a top plan view of the top portion of the liquid diverter shown in FIG. 3.

Referring simultaneously to FIGS. 3 and 5, top member 80 includes a plurality of ribs 112 which are disposed to align with ribs 108 of bottom member 82. Ribs 112 extend between side walls 88 and 90. Top member 80 further includes a curvilinear surface 116 which extends between side walls 88 and 90. Curvilinear surface 116 matches the curve of ribs 108 in the area of apertures 102 and 104 of bottom member 82.

Figure 6:
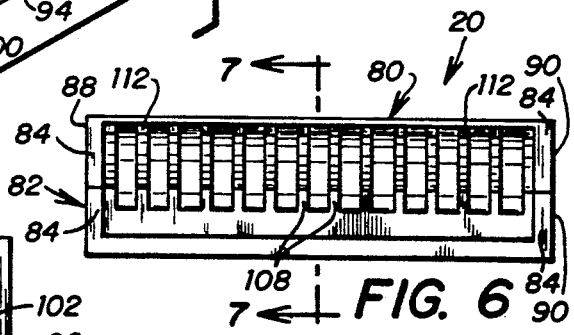
FIG. 6 is a front elevational view of the liquid diverter shown in FIG. 3.
Figure 7:
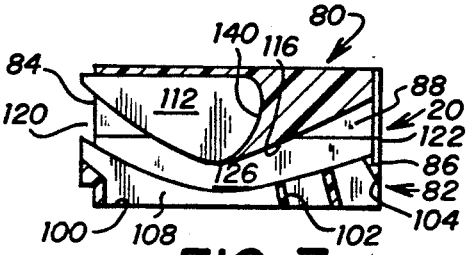
FIG. 7 is a cross-sectional view taken generally along sectional lines 7—7 of FIG. 6 illustrating the liquid diverter shown in FIG. 3.

Referring simultaneously to FIGS. 6 and 7, top member 80 and bottom member 82 form an inlet opening 120 for the receipt of currency 68 within side wall 84. An outlet opening 122 is disposed within side wall 86. Outlet opening 122 lies adjacent to slot 58 of bill validator 60. Disposed between inlet opening 120 and outlet opening 122 and formed by top member 80 and bottom member 82 of liquid diverter 20 is a channel 126 through which currency 68 passes during its path from the user of vending machine 22 to bill validator 60. Due to the curvilinear surfaces of ribs 108 of bottom member 82 and ribs 112 of top member 80, any liquid entering liquid diverter 20 through inlet opening 120 is directed downwardly to apertures 100, 102, and 104 for withdrawal from liquid diverter 20 and away from outlet opening 122. In this manner, liquid is prevented from exiting outlet opening 122 and from entering slot 58 of bill validator 60. Apertures 100, 102, and 104, thereby prevent liquid from entering bill validator 60 through door 26 of vending machine 22.

As best illustrated in FIG. 7, top member 80 further includes a recessed curvilinear surface 140 which is disposed within surface 116 and between ribs 112. Curvilinear surface 140 functions to divert liquid entering iniet opening 120 back towards inlet opening 120 to further prevent liquid from entering slot 58 of bill validator 160.

Figure 8:
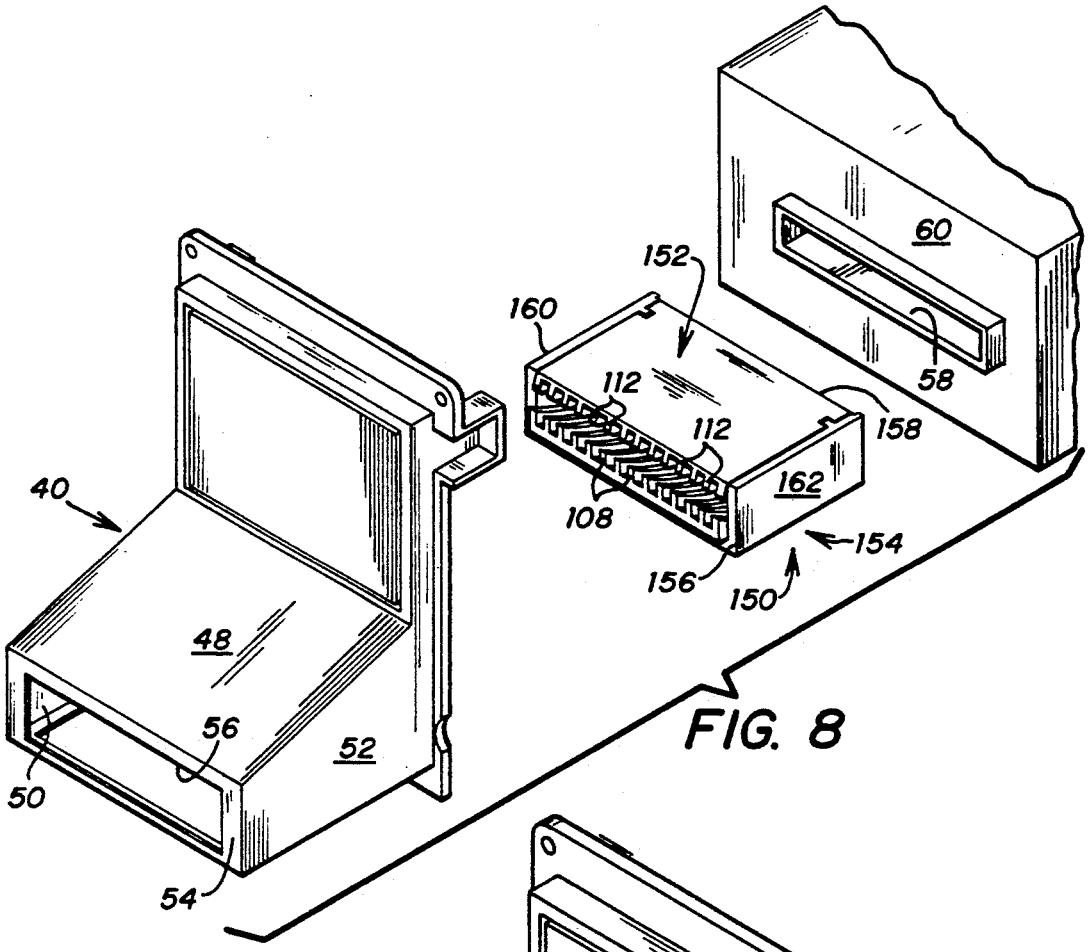
FIG. 8 is an exploded perspective view of a second embodiment of the present liquid diverter.
Figure 9:
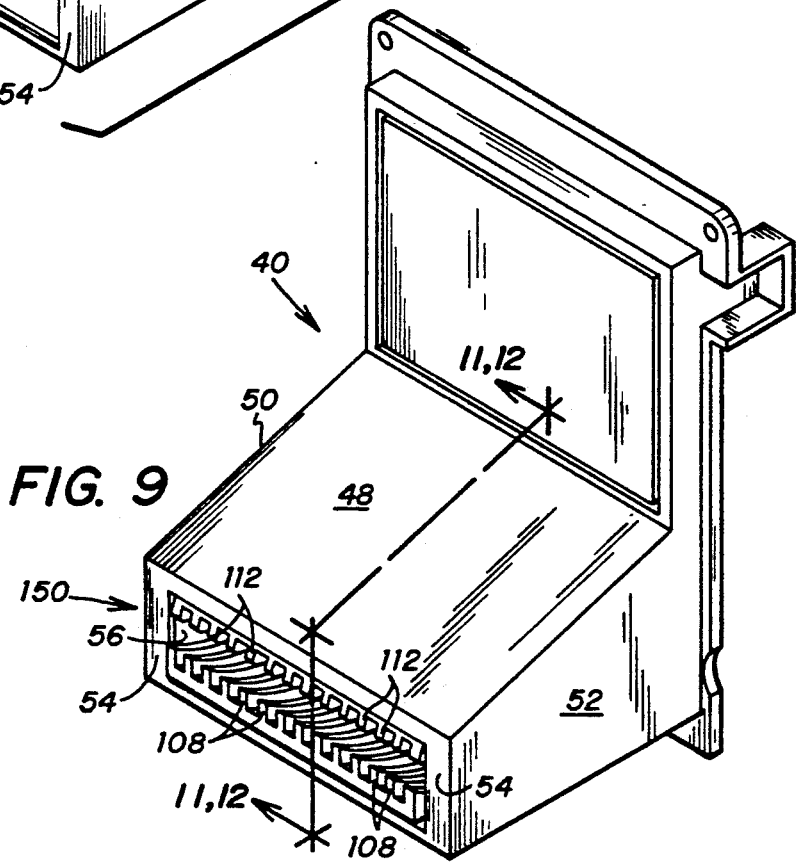
FIG. 9 is a perspective view of the liquid diverter shown in FIG. 8 disposed within a housing.

Referring now simultaneously to FIGS. 8 and 9, a further embodiment of the present liquid diverter is illustrated, and is generally identified by the numeral 150. Like numerals are utilized for like and corresponding components previously identified with regard to FIGS. 1–7. Liquid diverter 150 operates in a similar manner as liquid diverter 20 to prevent liquid from entering slot 58 of bill validator 60 and has an additional function of closing channel 126 at outlet opening 122 to yet provide an additional mechanism for preventing liquid from entering slot 58 of bill validator 60.

Figure 10:
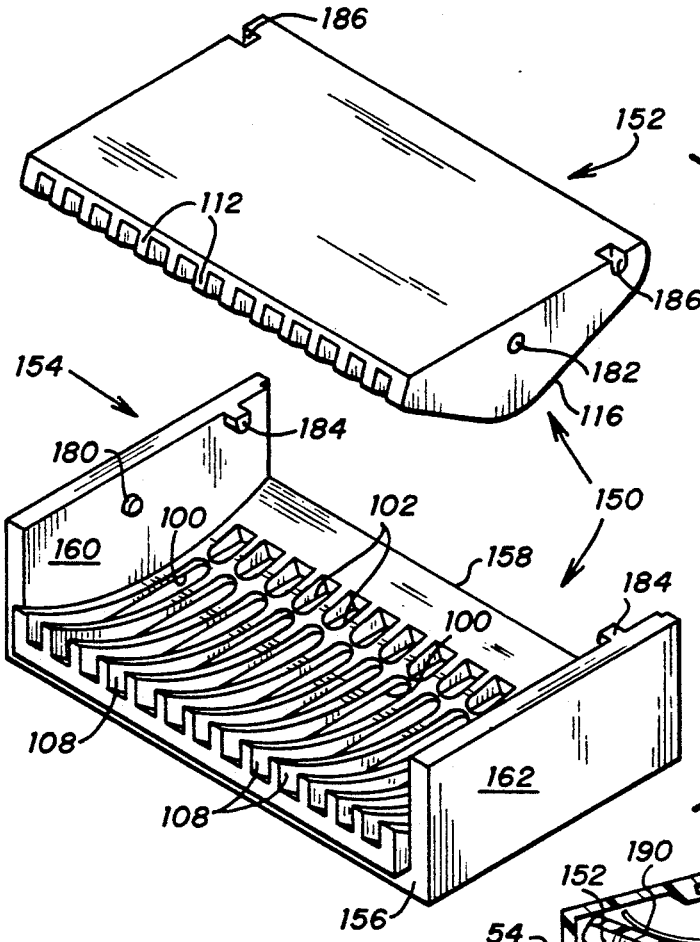
FIG. 10 is an exploded perspective view of the liquid diverter shown in FIG. 8.

Referring now to FIGS. 8, 9, and 10, liquid diverter 150 includes a top member generally identified by the numeral 152 and a bottom member generally identified by the numeral 154. Liquid diverter 150 further includes a first side wall 156, a second side wall 158, a first end wall 160 and a second end wall 162. Bottom member 154 includes apertures 100 and 102. Disposed between apertures 100 and 102 are ribs 108 similar to bottom member 82 of liquid diverter 20. Top member 152 is configured similarly to top member 80 of liquid diverter 20 and includes curvilinear surface 116, ribs 112 and interior curvilinear surface 140.

An important aspect of liquid diverter 150 is that top member 152 is pivotally mounted to bottom member 154. First end wall 160 and second end wall 162 include a centrally disposed mounting pin 180 which each engage a corresponding aperture 182 within top member 152, such that top member 152 can pivot about locating pin 180 in a clock wise direction with respect to bottom member 154 of liquid diverter 150. First end wall 160 and second end wall 162 further include a stop 184 which engages a slot 186 within top member 152 to prevent the counterclockwise rotation of top member 152 with respect to bottom member 154.

Figure 12:
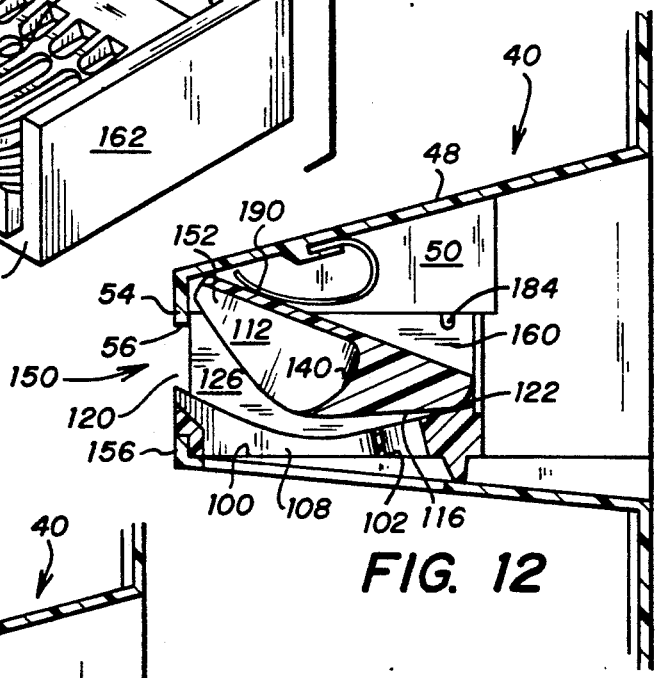
FIG. 12 is a cross-sectional view of the liquid diverter of FIG. 8 shown in the closed position and taken generally along sectional lines 12—12 of FIG. 9.
Figure 11:
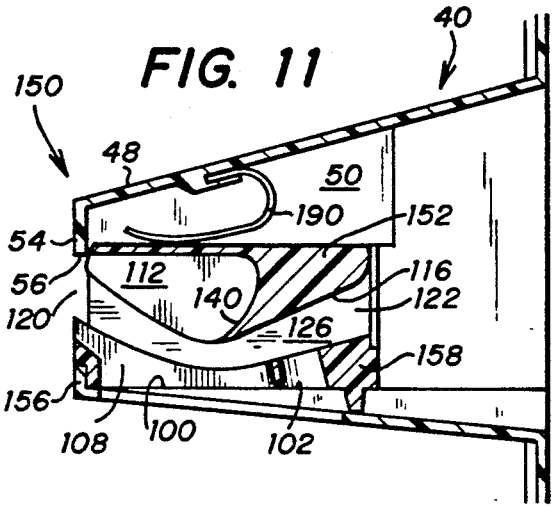
FIG. 11 is a cross-sectional view of the liquid diverter of FIG. 8 shown in the open position and taken generally along sectional lines 11—11 of FIG. 9.

Referring now to FIGS. 11 and 12, the operation of liquid diverter 150 will now be described. As illustrated in FIG. 11, mounted within housing 40, is a biasing device 190, such as for example, a spring which is interconnected to top wall 48. Device 190 contacts top member 152 and biases top member 152 in the position as illustrated in FIG. 11. In this position, channel 126 is open to create a passageway from inlet opening 120 to outlet opening 122 which allows currency to pass into slot 58 of bill validator 60. Liquid diverter 150 operates in a manner similar to liquid diverter 20 as previously explained wherein liquid is forced to exit liquid diverter 150 through apertures 100 and 102. Additionally, liquid is redirected towards inlet opening 120 through operation of surface 140.

Referring now to FIG. 12, in the event an object such as, for example, a nozzle is placed within inlet opening 120 thereby contacting top member 152 of liquid diverter 150, the force of the object on top member 152 overcomes the spring bias of device 190 to thereby allow top member 152 to rotate in a clockwise direction. Rotation of top member 152 as illustrated in FIG. 12, causes the closure of channel 126 at outlet opening 122 as a further measure to prevent the entrance of liquid into slot 58 of bill validator 60. When the foreign object is removed from inlet opening 120, device 190 causes top member 152 to return to its normal position as illustrated in FIG. 11 to allow the passage of currency through channel 126 of liquid diverter 150.

It therefore can be seen that the present invention provides for a liquid diverter for the diversion of liquid in a currency receiving device of a vending machine to prevent the introduction of liquid into a bill validator. The present invention defines a channel or passageway through which currency passes and which will simultaneously divert outwardly any liquid which enters the channel. Additionally, the present invention provides for the closure of a channel through which currency passes in order to further prevent the possibility of liquid entering the slot of a bill validator.

Whereas the present invention has been described with respect to specific embodiments thereof, it will be understood that various changes and modifications will be suggested to one skilled in the art and it is intended to encompass such changes and modifications as fall within the scope of the appended claims.

We claim:

1. A liquid diverting device for a currency receiver having an entrance slot for receipt of currency, the device comprising:

means for diverting liquid from the entrance slot of the currency receiver;

said diverting means having a top wall, a bottom wall, first and second side walls, and first and second end walls and being disposed adjacent to the entrance slot of the currency receiver;

said first side wall including an inlet slot for receipt of currency, said second side wall including an outlet slot for passing currency to the entrance slot of the currency receiver, said outlet slot being aligned with the entrance slot of the currency receiver;

said diverting means including a channel interconnecting said inlet slot and said outlet slot and extending between said top and bottom walls and said side walls for providing a passageway for currency through said diverting means;

said bottom wall including a plurality of apertures for the removal of liquid from said channel; and said top wall including a plurality of spaced apart ribs and means disposed between said plurality of spaced apart ribs for redirecting liquid entering said inlet slot toward said inlet slot.

2. The liquid diverting device of claim 1 wherein said bottom wall includes a plurality of spaced apart ribs.

3. The liquid diverting device of claim 1 wherein said top wall includes an arcuate portion extending into said channel.

4. A liquid diverting device for a currency receiver having an entrance slot for receipt of currency, the device comprising:

means for diverting liquid from the entrance slot of the currency receiver;

said diverting means having a top wall, a bottom wall, first and second side walls, and first and second end walls and being disposed adjacent to the entrance slot of the currency receiver;

said first side wall including an inlet slot for receipt of currency, said second side wall including an outlet slot for passing currency to the entrance slot of the currency receiver, said outlet slot being aligned with the entrance slot of the currency receiver;

said diverting means including a channel interconnecting said inlet slot and said outlet slot and extending between said top and bottom walls and said side walls for providing a passageway for currency through said diverting means;

said bottom wall including a plurality of apertures for the removal of liquid form said channel; and said top wall including a plurality of spaced apart ribs and means disposed between said plurality of spaced apart ribs for redirecting liquid entering said inlet slot toward said inlet slot; and means extending from said top wall into said channel for directing liquid entering said inlet slot toward said plurality of apertures in said bottom wall, thereby diverting liquid from said outlet slot and away from the entrance to the currency receiver.

5. The liquid diverting device of claim 4 wherein said bottom wall includes a plurality of spaced apart ribs.

6. The liquid diverting device of claim 4 wherein said means extending from said top wall includes a plurality of spaced apart ribs.

7. The liquid diverting device of claim 4 herein said top wall includes an arcuate portion extending into said channel.

8. A liquid diverting device for a currency receiver having an entrance slot for receipt of currency, the device comprising:

means for diverting liquid from the entrance slot of the currency receiver;

said diverting means having a top wall, a bottom wall, first and second side walls, and first and second end walls and being disposed adjacent to the entrance slot of the currency receiver;

said first side wall including an inlet slot for receipt of currency, said second side wall including an outlet slot for passing currency to the entrance slot of the currency receiver, said outlet slot being aligned with the entrance slot of the currency receiver;

said diverting means including a channel interconnecting said inlet slot and said outlet slot and extending between said top and bottom walls and said side walls for providing a passageway for currency through said diverting means;

said bottom wall including a plurality of apertures for the removal of liquid from said channel; and means for pivotally mounting said top wall to said bottom wall for selectively opening and closing said outlet slot.

9. The liquid diverting device of claim 8 and further including:

means extending from said top wall into said channel for directing liquid entering said inlet slot toward said plurality of apertures in said bottom wall.

10. The liquid diverting device of claim 9 wherein said means extending from said top wall includes:

an arcuate portion adjacent to said outlet slot and a plurality of spaced apart ribs disposed adjacent to said inlet slot.

11. The liquid diverter of claim 10 wherein said top wall includes:

means disposed between said plurality of spaced apart ribs for redirecting liquid entering said inlet slot toward said inlet slot.

12. The liquid diverting device of claim 11 wherein said bottom wall includes a plurality of spaced apart ribs disposed between said plurality of apertures and aligned with said top wall plurality of ribs.

13. A liquid diverting device for a currency receiver having an entrance slot for receipt of currency, the device comprising:

means for diverting liquid from the entrance slot of the currency receiver;

said diverting means having a top wall, a bottom wall, first and second side walls, and first and second end walls and being disposed adjacent to the entrance slot of the currency receiver;

said first side wall including an inlet slot for receipt of currency, said second side wall including an outlet slot for passing currency to the entrance slot of the currency receiver, said outlet slot being aligned with the entrance slot of the currency receiver;

said diverting means including a channel interconnecting said inlet slot and said outlet slot and extending between said top and bottom walls and said side walls for providing a passageway for currency through said diverting means;

said top wall being pivotally mounted to said bottom wall for selectively opening and closing said outlet slot;

said bottom wall including a plurality of apertures for the removal of liquid from said channel; and means extending from said top wall into said channel for directing liquid entering said inlet slot toward said plurality of apertures in said bottom wall, thereby diverting liquid from said outlet slot and away from the entrance to the currency receiver.

14. A liquid diverting device for a currency receiver having an entrance slot for receipt of currency, the device comprising:

means for diverting liquid from the entrance slot of the currency receiver;

said diverting means having a top wall, a bottom wall, first and second side walls, and first and second end walls and being disposed adjacent to the entrance slot of the currency receiver;

said first side wall including an inlet slot for receipt of currency, said second side wall including an outlet slot for passing currency to the entrance slot of the currency receiver, said outlet slot being aligned with the entrance slot of the currency receiver;

said diverting means including a channel interconnecting said inlet slot and said outlet slot and extending between said top and bottom walls and said side walls for providing a passageway for currency through said diverting means;

said bottom wall including a plurality of apertures for the removal of liquid from said channel;

means extending from said top wall into said channel including an arcuate portion adjacent to said outlet slot and a plurality of spaced apart ribs disposed adjacent to said inlet slot for directing liquid entering said inlet slot toward said plurality of apertures in said bottom wall, thereby diverting liquid from said outlet slot and away from the entrance to the currency receiver; and means disposed between said plurality of spaced apart ribs for redirecting liquid entering said inlet slot toward said inlet slot.

15. The liquid diverting device of claim 14 wherein said bottom wall includes a plurality of spaced apart ribs disposed between said plurality of apertures and aligned with said top wall plurality of ribs.

* * * * *